US012716608B2

(12) United States Patent
Zou

(10) Patent No.: US 12,716,608 B2
(45) Date of Patent: Aug. 25, 2026

(54) AIR CONDITIONER CONTROL METHOD, AIR CONDITIONER, STORAGE MEDIUM AND DEVICE

(71) Applicants: WUHU MATY AIR-CONDITIONING EQUIPMENT CO., LTD., Wuhu (CN); GD MIDEA AIR-CONDITIONING EQUIPMENT CO., LTD., Foshan (CN)

(72) Inventor: Dashu Zou, Wuhu (CN)

(73) Assignees: WUHU MATY AIR-CONDITIONING EQUIPMENT CO., LTD., Wuhu (CN); GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 402 days.

(21) Appl. No.: 18/287,716

(22) PCT Filed: Jun. 29, 2021

(86) PCT No.: PCT/CN2021/103143
§ 371 (c)(1),
(2) Date: Oct. 20, 2023

(87) PCT Pub. No.: WO2022/227261
PCT Pub. Date: Nov. 3, 2022

(65) Prior Publication Data

US 2024/0183560 A1 Jun. 6, 2024

(30) Foreign Application Priority Data

Apr. 26, 2021 (CN) ..... 202110457832.6

(51) Int. Cl.
*F24F 11/65* (2018.01)

(52) U.S. Cl.
CPC ..... *F24F 11/65* (2018.01)

(58) Field of Classification Search
CPC .. F24F 11/65; F24F 11/00; F24F 11/84; F24F 13/24; F24F 2013/247; F25B 41/20; F25B 41/30; F25B 41/34; Y02B 30/70
See application file for complete search history.

(56) References Cited

U.S. PATENT DOCUMENTS 5,555,744 A * 9/1996 Hirano ..... F25B 47/022 62/352
5,878,589 A * 3/1999 Tanaka ..... F25B 1/10 165/80.2

(Continued)

FOREIGN PATENT DOCUMENTS

CN 101545689 A 9/2009
CN 101639298 A 2/2010

(Continued)

OTHER PUBLICATIONS

The World Intellectual Property Organization (WIPO) International Search Report and Written opinion for PCT/CN2021/103143 Jan. 6, 2022 14 pages (including English translation).

(Continued)

*Primary Examiner* — Zhipeng Wang
(74) *Attorney, Agent, or Firm* — Anova Law Group, PLLC

(57) ABSTRACT

An air conditioner control method includes in response to that an air conditioner is in a refrigeration mode, detecting whether a refrigeration electronic expansion valve exists in a path communicating an indoor unit and an outdoor unit of the air conditioner; and in response to determining that the refrigeration electronic expansion valve exists in the path, controlling a refrigeration throttle valve to close and a refrigeration solenoid valve to open. The refrigeration throttle valve and the refrigeration solenoid valve are provided in parallel in the path. The method further includes (Continued)

activating the refrigeration electronic expansion valve to throttle the air conditioner.

20 Claims, 10 Drawing Sheets

(56) References Cited

U.S. PATENT DOCUMENTS

| | | | | |
|---|---|---|---|---|
| 9,103,557 | B2 * | 8/2015 | Choi | F24F 11/84 |
| 2011/0154834 | A1 * | 6/2011 | Choi | G05D 23/1932 62/56 |

FOREIGN PATENT DOCUMENTS

| | | | | | |
|---|---|---|---|---|---|
| CN | 203731756 | U | | 7/2014 | |
| CN | 105928094 | A | | 9/2016 | |
| CN | 107144057 | A | * | 9/2017 | F25B 41/31 |
| CN | 110044096 | A | | 7/2019 | |
| CN | 110530046 | A | | 12/2019 | |
| CN | 111795474 | A | | 10/2020 | |
| JP | 2004263975 | A | | 9/2004 | |
| JP | 2006153349 | A | | 6/2006 | |
| KR | 20130065170 | A | | 6/2013 | |

OTHER PUBLICATIONS

The China National Intellectual Property Administration (CNIPA) The First Office Action for Chinese Application 202110457832.6 Oct. 19, 2023 17 Pages (With Translation).

* cited by examiner

AIR CONDITIONER CONTROL METHOD, AIR CONDITIONER, STORAGE MEDIUM AND DEVICE

CROSS-REFERENCE TO RELATED APPLICATIONS

The present application is a National Stage Entry under 35 U.S.C. § 371 of International Application No. PCT/CN2021/103143, filed on Jun. 29, 2021, which claims priority to Chinese Patent Application No. 202110457832.6, filed on Apr. 26, 2021, the entire contents of both of which are incorporated herein by reference.

TECHNICAL FIELD

The present application relates to the technical field of air conditioner, and in particular to an air conditioner control method, an air conditioner, a storage medium and a device.

BACKGROUND

At present, air conditioners from different manufacturers have different throttling methods. One way is to install the refrigeration throttle assembly on the outdoor side for throttling, and the other way is to install the refrigeration throttle assembly on the indoor side for throttling. Therefore, when products produced by different manufacturers are matched, the product with the refrigeration throttle assembly on the outside may be matched with the product with the refrigeration throttle assembly on the inside, resulting in double throttle valves, which produces noises on the indoor side and affects the comfort.

The above is only used to assist in understanding the technical solutions of the present application and does not represent an admission that the above is prior art.

Technical Problem

The main objective of the present application is to provide an air conditioner control method, an air conditioner, a storage medium and a device, aiming to solve the technical problem that when products produced by different manufacturers are matched, the product with the refrigeration throttle assembly on the outside may be matched with the product with the refrigeration throttle assembly on the inside, resulting in double throttle valves, which produces noises on the indoor side and affects the comfort.

Technical Solution

In order to achieve the above objective, the present application provides an air conditioner control method applied to an air conditioner. The air conditioner includes: an indoor unit and an outdoor unit, and a refrigeration throttle valve and a refrigeration solenoid valve being provided in parallel in a path communicating the outdoor unit to the indoor unit.

The air conditioner control method includes the following steps:

in response to that the air conditioner is in a refrigeration mode, detecting an existence of a refrigeration electronic expansion valve in the path communicating the indoor unit and the outdoor unit;

based on the detection of the existence of the refrigeration electronic expansion valve, controlling the refrigeration throttle valve to close and the refrigeration solenoid valve to open; and activating the refrigeration electronic expansion valve to throttle the air conditioner.

In an embodiment, the activating the refrigeration electronic expansion valve to throttle the air conditioner includes:

obtaining an overheat degree of the refrigeration electronic expansion valve; and adjusting an opening degree of the refrigeration electronic expansion valve according to the overheat degree of the refrigeration electronic expansion valve, so as to throttle the air conditioner.

In an embodiment, based on the detection of the existence of the refrigeration electronic expansion valve, the controlling the refrigeration throttle valve to close and the refrigeration solenoid valve to open includes:

based on the detection of the existence of the refrigeration electronic expansion valve, obtaining an outlet temperature of a condenser of the outdoor unit; and adjusting the opening degree of the refrigeration solenoid valve according to the outlet temperature of the condenser, and the refrigeration throttle valve to close.

In an embodiment, in response to that the air conditioner is in the refrigeration mode, after the detecting whether there is the refrigeration electronic expansion valve in the path communicating the indoor unit and the outdoor unit, the air conditioner control method further includes:

in response to that there is no refrigeration electronic expansion valve, controlling the refrigeration solenoid valve to close; and activating the refrigeration throttle valve to throttle the air conditioner.

In an embodiment, the activating the refrigeration throttle valve to throttle the air conditioner includes:

obtaining an overheat degree of the refrigeration throttle valve; and adjusting the opening degree of the refrigeration throttle valve according to the overheat degree of the refrigeration throttle valve to throttle the air conditioner.

In an embodiment, in response to that the air conditioner is in the refrigeration mode, the detecting whether there is the refrigeration electronic expansion valve in the path communicating the indoor unit and the outdoor unit includes:

in response to that the air conditioner is in the refrigeration mode, obtaining information of the indoor unit; and extracting an equipment identification of the indoor unit from the information of the indoor unit, and detecting whether there is the refrigeration electronic expansion valve in the indoor unit according to the equipment identification of the indoor unit.

In an embodiment, the air conditioner further includes: a heating electronic expansion valve;

in response to that the air conditioner is in the refrigeration mode, before the detecting whether there is the refrigeration electronic expansion valve in the path communicating the indoor unit and the outdoor unit, the air conditioner control method further includes:

detecting a current working mode of the air conditioner;

in response to that the air conditioner is in the heating mode, adjusting the refrigeration electronic expansion valve to a preset opening degree, and activating the refrigeration throttle valve; and controlling the refrigeration solenoid valve to close, and opening the heating electronic expansion valve to throttle the air conditioner.

In addition, to realize the above objective, the present application also provides an air conditioner, including: a memory, a processor, and an air conditioner control program stored in the memory and executable on the processor, and the air conditioner control program is configured to implement the air conditioner control method.

In addition, to realize the above objective, the present application also provides a storage medium, an air conditioner control program is stored on the storage medium, and in response to that the air conditioner control program is executed by a processor, the air conditioner control method is implemented.

In addition, to realize the above objective, the present application also provides an air conditioner control device, including: a detection module and a control module;

in response to that the air conditioner is in the refrigeration mode, the detection module is configured to detect an existence of a refrigeration electronic expansion valve in an indoor unit;

based on the detection of the existence of the refrigeration electronic expansion valve, the control module is configured to control the refrigeration throttle valve to close and control the refrigeration solenoid valve to open; and the control module is also configured to activate the refrigeration electronic expansion valve to throttle the air conditioner.

Beneficial Effect

In the present application, the refrigeration throttle valve and the refrigeration solenoid valve are provided in parallel in the path communicating the outdoor unit and the indoor unit. In response to that the air conditioner is in the refrigeration mode, detecting an existence of a refrigeration electronic expansion valve in the path communicating the indoor unit and the outdoor unit. Based on the detection of the existence of the refrigeration electronic expansion valve, controlling the refrigeration throttle valve to close, controlling the refrigeration solenoid valve to open, and activating the refrigeration electronic expansion valve to throttle the air conditioner. Thus, in response to detecting that there is the refrigeration electronic expansion valve on the indoor side, bypassing the refrigeration solenoid valve, so as to overcome the noise in the room resulting from the double throttle valves when the product with the refrigeration throttle assembly inside is connected, thereby improving product competitiveness.

REFERENCE CHARACTER DESCRIPTION

Figure 1:
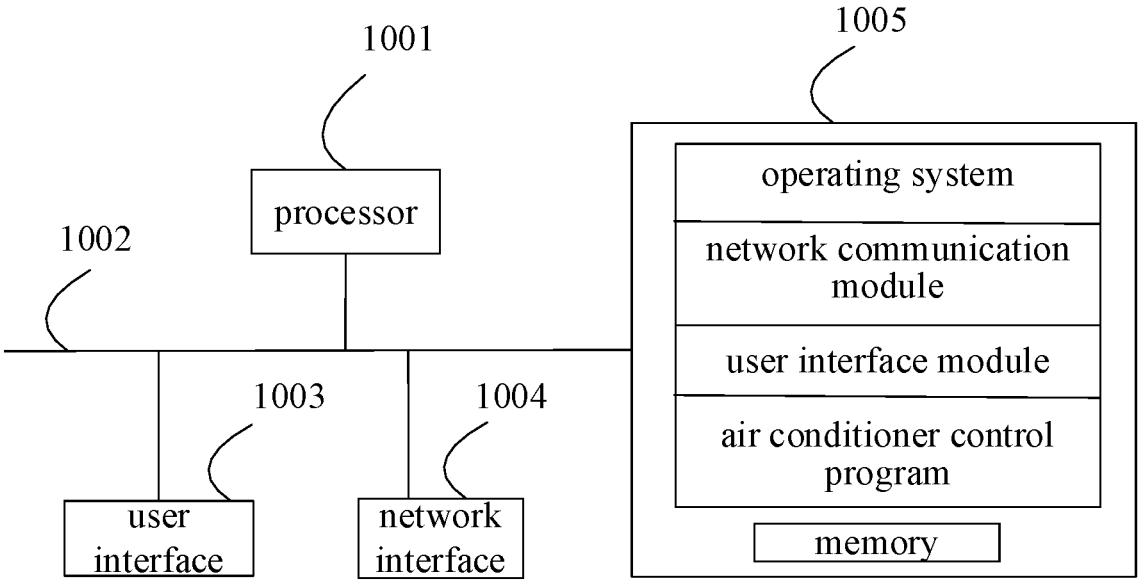
FIG. 1 is a schematic structural view of an air conditioner as a hardware operating environment according to an the embodiment of the present application.

| Reference character | Name |
|---|---|
| 1 | Compressor |
| 2 | Four-way valve |
| 3 | Condenser |
| 31 | Upper blower |
| 32 | Lower blower |
| 33 | Pipeline temperature sensor |
| 34 | Outdoor environment temperature sensor |
| 4 | Filter |
| 5 | Heating electronic expansion valve |
| 6 | Refrigeration throttle valve |
| 61 | Refrigeration solenoid valve |
| 7 | Filter |
| 8 | Evaporator |
| 81 | Inner blower |
| 82 | Indoor pipeline temperature sensor |
| 83 | Indoor environment temperature sensor |
| 84 | Refrigeration electronic expansion valve |
| 9 | Gas-liquid separator |

The achievement of the purpose of the present application, functional characteristics and advantages will be further described with reference to the accompanying drawings in conjunction with embodiments.

DETAILED DESCRIPTION OF THE EMBODIMENTS

It should be understood that the embodiments described here are only intended to illustrate and are not intended to limit the present application.

Referring to FIG. 1, FIG. 1 is a schematic structural view of an air conditioner as a hardware operating environment according to an the embodiment of the present application.

As shown in FIG. 1, the air conditioner may include: an indoor unit and an outdoor unit, and a refrigeration throttle valve and a refrigeration solenoid valve being provided in parallel in a path communicating the outdoor unit and the indoor unit. The air conditioner may also include: a processor 1001, such as a central processing unit (CPU), a communication bus 1002, a user interface 1003, a network interface 1004, and a memory 1005. The communication bus 1002 is used to implement a connection communication between these assemblies. The user interface 1003 may include a display screen (Display). The user interface 1003 may also include a standard wired interface and a wireless interface. In the present application, the wired interface of the user interface 1003 may be a USB interface. The network interface 1004 may include a standard wired interface or a wireless interface (such as a wireless fidelity (WI-FI) interface). The memory 1005 may be a high-speed random access memory (RAM) memory or a non-volatile memory (NVM), such as a disk memory. The memory 1005 may also be a storage device independent of the aforementioned processor 1001.

For those skilled in the art, the structure shown in FIG. 1 does not constitute a limitation on the air conditioner, and may include more or fewer components, a combination of some components, or differently arranged components than shown in the figure.

As shown in FIG. 1, the memory 1005, which is recognized as the computer storage medium, may include an operating system, a network communication module, a user interface module, and an air conditioner control program.

In the air conditioner shown in FIG. 1, the network interface 1004 is mainly used to connect to a backend server and perform a data communication with the backend server. The user interface 1003 is mainly used to connect to the user's equipment. The air conditioner calls the air conditioner control program stored in the memory 1005 through the processor 1001, and executes the air conditioner control method provided in the embodiment of the present application.

Based on the above hardware structure, the present application provides an embodiment of the air conditioner control method.

Figure 2:
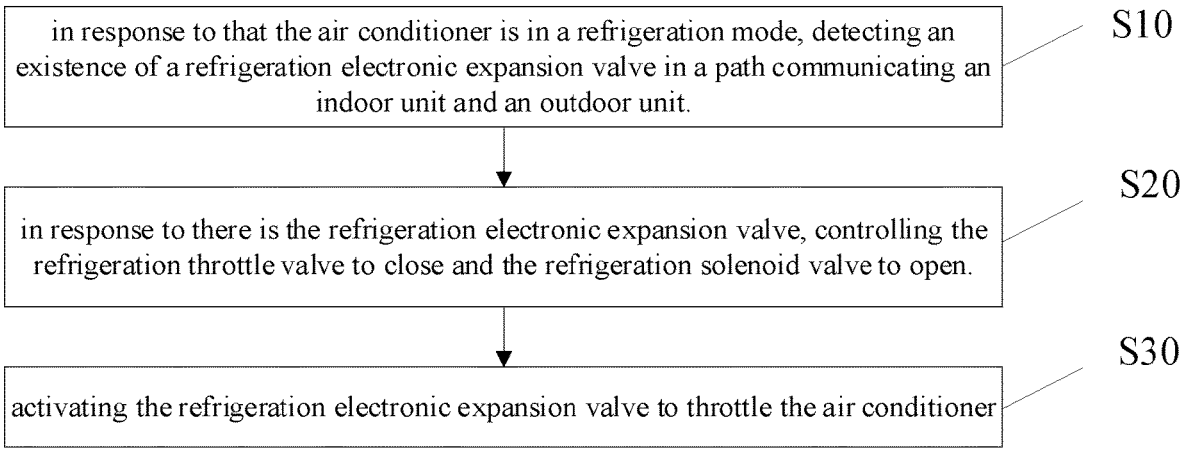
FIG. 2 is a schematic flowchart of an air conditioner control method according to a first embodiment of the present application.

Referring to FIG. 2, FIG. 2 is a schematic flowchart of the air conditioner control method according to the first embodiment of the present application. The first embodiment of the air conditioner control method of the present application is provided.

In the first embodiment, the air conditioner control method is applied to the air conditioner. The air conditioner includes an indoor unit and an outdoor unit. A refrigeration throttle valve and a refrigeration solenoid valve being provided in parallel in a path communicating the outdoor unit to the indoor unit.

Figure 3:
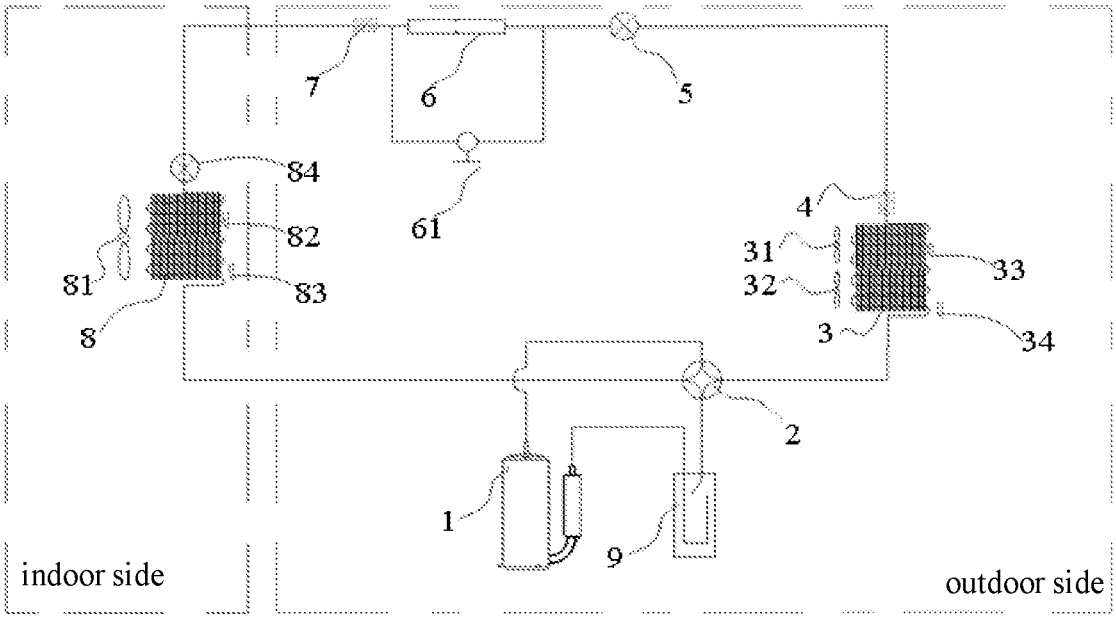
FIG. 3 is a schematic system diagram of an air conditioner of the air conditioner control method according to an embodiment of the present application.

For ease of understanding, an example is provided with reference to FIG. 3. FIG. 3 is a schematic system diagram of the air conditioner of the air conditioner control method according to an embodiment of the present application. The air conditioner includes a compressor 1, a four-way valve 2, a condenser 3, an upper blower 31, a lower blower 32, and a pipeline temperature sensor 33, an outdoor environment temperature sensor 34, a filter 4, a heating electronic expansion valve 5, a refrigeration throttle valve 6, a refrigeration solenoid valve 61, a filter 7, an evaporator 8, an inner blower 81, an indoor pipeline temperature sensor 82, an indoor environment temperature sensor 83, a refrigeration electronic expansion valve 84 and a gas-liquid separator 9. The compressor 1 is used for compressing and transporting the refrigerant. The four-way valve 2 is used to switch between refrigeration and heating. in response to the air conditioner is in the refrigeration mode, the condenser 3 is used as a condensing end to dissipate the heat for the refrigerant; in response to the air conditioner is in the heating mode, the condenser 3 is used as an evaporation end to absorb the heat for the refrigerant. The upper blower 31 and the lower blower 32 are used to drive an outdoor air to pass through the heat ex-changer, so that the air exchanges heat with the refrigerant in the pipe. The pipeline temperature sensor 33 is used to detect the temperature of a surface of the copper pipeline. The outdoor environment temperature sensor 34 is used to detect the temperature of the outdoor air. The filter 4 and the filter 7 are used to prevent impurities in the system from entering the throttle assemblies, resulting in a poor throttling function or a dirt and blockage. in response to the air conditioner is in the heating mode, the heating electronic expansion valve 5 is used for throttling and reducing a pressure; in response to the air conditioner is in the refrigeration mode, the heating electronic expansion valve 5 is set to a maximum of 480 steps without the throttling function, that is, throttling at one-way, and full opening at reverse without throttling. in response to the air conditioner is in the refrigeration mode, the refrigeration solenoid valve 61 is closed, and the refrigeration electronic expansion valve 84 is opened to a maximum of 480 steps, the refrigeration throttle valve 6 is used to play the role of throttling and reducing the pressure. If the refrigeration solenoid valve 61 is opened, the refrigeration throttle valve 6 has no throttling function, and the refrigeration electronic valve expansion valve 84 has the function of throttling and reducing the pressure, which is controlled by a overheat degree. The refrigeration throttle valve 6 does not function in response to the air conditioner is in the heating mode. in response to the air conditioner is in the heating mode, the refrigeration throttle valve 6 no longer throttles, that is, throttling at one-way, and no throttling at reverse. The refrigeration solenoid valve 61 is in a normally closed state. After energized, the refrigeration solenoid valve 61 functions to bypass the refrigeration solenoid valve, and reduce a pressure drop of the refrigerant and make the refrigerant before throttling by the refrigeration electronic expansion valve 84 to be in a liquid state, thus preventing the gas-liquid mixture which produces a refrigerant sound. In response to the air conditioner is in the refrigeration mode, the evaporator 8 is used as the evaporation end to absorb the heat for the refrigerant; in response to the air conditioner is in the heating mode, the evaporator 8 is used as the condensation end to dissipate the heat for the refrigerant. The inner blower 81 is used to drive the indoor air to pass through the heat ex-changer, so that the air exchanges heat with the refrigerant in the pipe. The indoor pipeline temperature sensor 82 is used to detect the temperature of the surface of the copper pipeline of the indoor heat ex-changer. The indoor environment temperature sensor 83 is used to detect the temperature of the indoor environment. In response to the air conditioner is in the refrigeration mode, the refrigeration electronic expansion valve 84 is used to control the electronic expansion valve according to the overheat degree; in response to the air conditioner is in the heating mode, the refrigeration electronic expansion valve 84 reaches a maximum of 480 steps and has no throttling function. The gas-liquid separator 9 is used to separate the gas and liquid refrigerants in the system. The gas refrigerant returns to the compressor to continue the compression cycle, while the liquid refrigerant remains in the gas-liquid separator to avoid a compressor liquid shock. The outdoor unit in the present application may include the condenser 3, the upper blower 31, the lower blower 32, the pipeline temperature sensor 33, and the outdoor environment temperature sensor 34. The indoor unit may include the evaporator 8, the inner blower 81, the indoor pipeline temperature sensor 82 and the indoor environment temperature sensor 83, which is not limited in this embodiment.

The air conditioner control method includes the following steps:

S10: in response to that the air conditioner is in a refrigeration mode, detecting an existence of a refrigeration electronic expansion valve in a path communicating an indoor unit and an outdoor unit.

It should be understood that the execution subject of this embodiment is the air conditioner. In response to the air conditioner is in the refrigeration mode, the electronic expansion valve is controlled according to the overheat degree; in response to the air conditioner is in the heating mode, the electronic expansion valve reaches the maximum opening degree and has no throttling function. The maximum opening degree being 480 steps is taken as an example for description.

When products produced by different manufacturers are matched, the product with the refrigeration throttle assembly on the outside may be matched with the product with the refrigeration throttle assembly on the inside, resulting in double throttle valves, which produces noises on the indoor side and affects the comfort. Therefore, it is necessary to detect an existence of a refrigeration electronic expansion valve in the path communicating the indoor unit and the outdoor unit.

S20: in response to there is the refrigeration electronic expansion valve, controlling the refrigeration throttle valve to close and the refrigeration solenoid valve to open.

It should be understood that in response to the refrigeration throttle valve is closed, there is no refrigerant circulation in the refrigeration throttle valve. In response to the refrigeration solenoid valve is opened, the refrigeration solenoid valve is activated, so that the bypass branch where the refrigeration solenoid valve is located is in an open state to circulate the refrigerant and reduce the pressure of the refrigerant. In this way, the refrigerant is in a liquid state when entering the refrigeration electronic expansion valve.

S30: activating the refrigeration electronic expansion valve to throttle the air conditioner.

It should be understood that after the refrigeration throttle valve is closed, only the refrigeration electronic expansion valve can throttle the refrigerant. Therefore, the refrigeration electronic expansion valve needs to be activated at this time, so that the refrigerant can be throttled in the refrigeration electronic expansion valve, and the refrigerant with low temperature and low pressure is formed.

Figure 4:
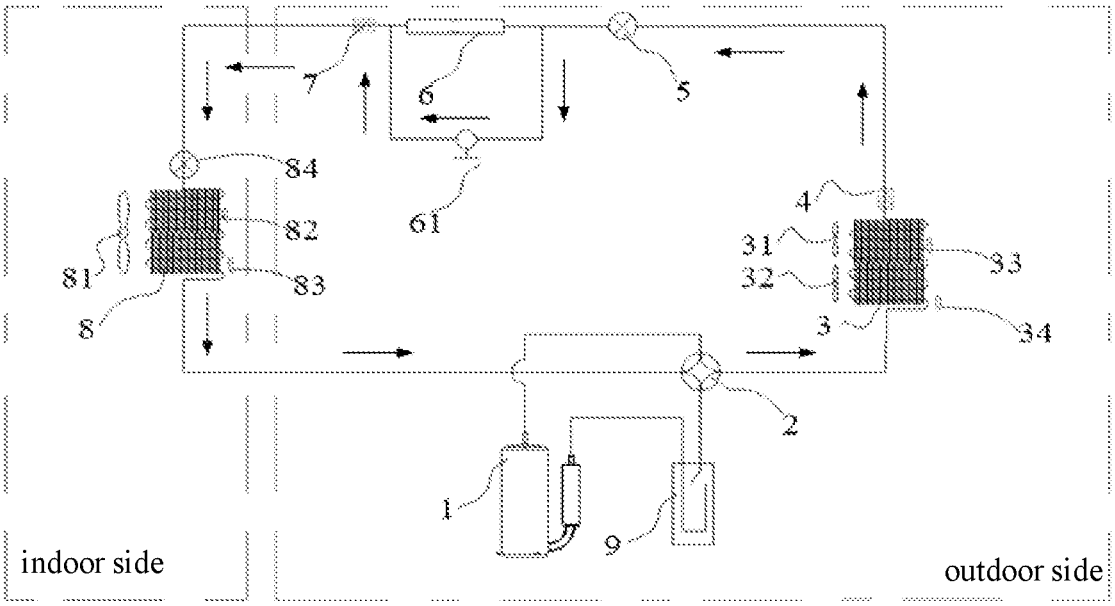
FIG. 4 is a schematic diagram showing a refrigerant flow in response to that the air conditioner is in a refrigeration mode and there is a refrigeration electronic expansion valve of the air conditioner control method according to an embodiment of the present application.

For ease of understanding, refer to FIG. 4. FIG. 4 is a schematic diagram showing the refrigerant flow in response to the air conditioner is in the refrigeration mode and there is the refrigeration electronic expansion valve of the air conditioner control method according to an embodiment of the present application. In response to that the air conditioner is in the refrigeration mode, the gas refrigerant with high temperature and high pressure discharged from the compressor 1 passes through the four-way valve 2, enters the condenser 3 side for heat dissipation, passes through the filter 4 and the heating electronic expansion valve 5 (at this time, the opening degree of the electronic expansion valve 5 reaches the maximum 480 steps and has no throttling function), and enters and bypasses the refrigeration solenoid valve 61, which reduces the pressure drop of the refrigerant, and causes the refrigerant to be in the liquid state when entering the refrigeration electronic expansion valve 84 to avoid the refrigerant sound produced by the gas-liquid in two-phase. After throttled by the refrigeration electronic expansion valve 84, the refrigerant with low temperature and low pressure is formed, then the refrigerant enters the indoor side evaporator 8 for endothermic evaporation, and flows into the gas-liquid separator 9 for gas-liquid separation. The gas refrigerant returns to the compressor 1 for circulation, and the liquid refrigerant is stored in the gas-liquid separator 9.

In the present application, the refrigeration throttle valve and the refrigeration solenoid valve being provided in parallel in the path communicating the outdoor unit and the indoor unit. In response to the air conditioner is in the refrigeration mode, it is detected an existence of a refrigeration electronic expansion valve in the path communicating the indoor unit and the outdoor unit. Based on the detection of the existence of the refrigeration electronic expansion valve, controlling the refrigeration throttle valve to close, controlling the refrigeration solenoid valve to open, and activating the refrigeration electronic expansion valve to throttle the air conditioner. Thus, in response to detecting that there is a refrigeration electronic expansion valve on the indoor side, bypassing the refrigeration solenoid valve, so as to overcome the noise in the room resulting from the double throttle valves when the product with the refrigeration throttle assembly inside is connected, thereby improving product competitiveness.

Figure 5:
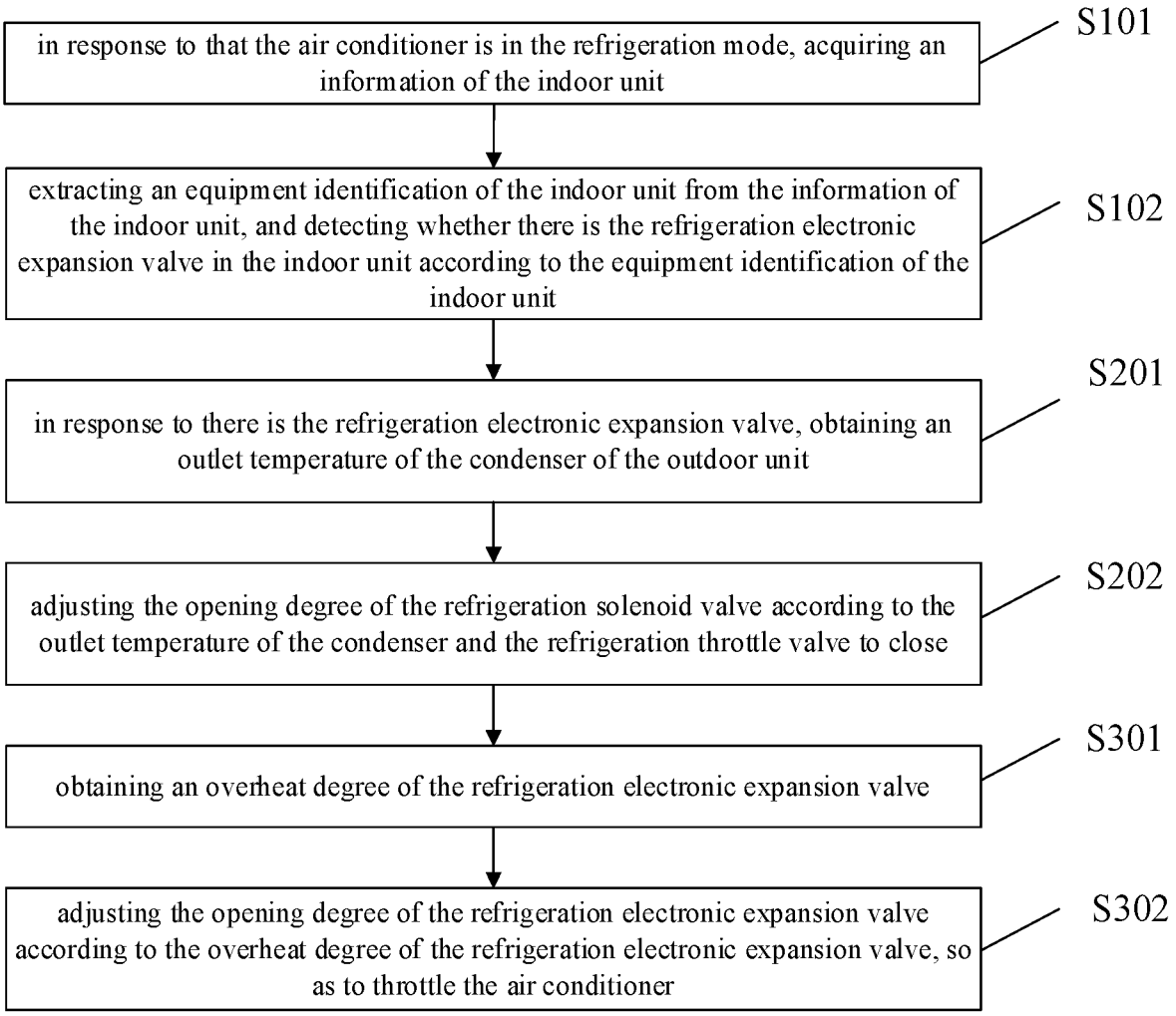
FIG. 5 is a schematic flowchart of an air conditioner control method according to a second embodiment of the present application.

Referring to FIG. 5, FIG. 5 is a schematic flowchart of an air conditioner control method according to a second embodiment of the present application. Based on the first embodiment shown in FIG. 2, the second embodiment of the air conditioner control method of the present application is provided.

In the second embodiment, S10 includes:

S101: in response to that the air conditioner is in the refrigeration mode, acquiring an information of the indoor unit.

It should be noted that the information of the indoor unit may be a manufacturer information or a model information of the indoor unit, which is not limited in this embodiment.

It should be understood that a storage space may be preset in the indoor unit for storing the information of the indoor unit. Therefore, obtaining the information of the indoor unit may be searching for the information of the indoor unit from the preset storage space. The information of the indoor unit may be pre-entered by the manufacturer of the air conditioner, which is not limited in this embodiment.

S102: extracting an equipment identification of the indoor unit from the information of the indoor unit, and detecting whether there is the refrigeration electronic expansion valve in the indoor unit according to the equipment identification of the indoor unit.

It should be noted that the equipment identification of the indoor unit may be an identification information used to represent an identity of the indoor unit, which is not limited in this embodiment.

It should be understood that detecting whether there is the refrigeration electronic expansion valve in the indoor unit according to the equipment identification of the indoor unit may be searching the equipment information corresponding to the equipment identification of the indoor unit in a preset information table, and determining whether there is the refrigeration electronic expansion valve in the indoor unit according to the equipment information. The preset information table includes the corresponding relationship between the indoor unit identification and the equipment information. The corresponding relationship between the indoor unit identification and the equipment information can be pre-entered by the indoor unit manufacturer when producing the indoor unit. The equipment information refers to which equipment the indoor unit is composed of.

In the second embodiment, by obtaining the information of the indoor unit, extracting the equipment identification of the indoor unit from the information of the indoor unit, and detecting whether there is the refrigeration electronic expansion valve in the indoor unit according to the equipment identification of the indoor unit, the detection accuracy and reliability of the refrigeration electronic expansion valve can be improved.

In the second embodiment, S20 includes:

S201: in response to there is the refrigeration electronic expansion valve, obtaining an outlet temperature of the condenser of the outdoor unit.

It should be understood that based on the detection of the existence of the refrigeration electronic expansion valve, the refrigerant needs to be bypassed through the refrigeration solenoid valve to reduce the pressure drop of the refrigerant. When reducing the pressure of the refrigerant, the opening degree of the refrigeration solenoid valve needs to be determined according to the outlet temperature of the condenser.

S202: adjusting the opening degree of the refrigeration solenoid valve according to the outlet temperature of the condenser and the refrigeration throttle valve to close.

In the second embodiment, by obtaining the outlet temperature of the condenser of the outdoor unit, adjusting the opening degree of the refrigeration solenoid valve according to the outlet temperature of the condenser, and the refrigeration throttle valve to close, the opening degree of the refrigeration solenoid valve can be adaptively adjusted, so as to reduce the pressure of the refrigerant.

In the second embodiment, S30 includes:

S301: obtaining an overheat degree of the refrigeration electronic expansion valve.

It should be noted that the overheat degree is used for expansion valves and refers to a temperature difference between a low pressure side and a steam in a temperature sensing bulb.

S302: adjusting the opening degree of the refrigeration electronic expansion valve according to the overheat degree of the refrigeration electronic expansion valve, so as to throttle the air conditioner.

It should be understood that adjusting the opening degree of the refrigeration electronic expansion valve according to the overheat degree of the refrigeration electronic expansion valve may be searching for the opening degree of the refrigeration electronic expansion valve corresponding to the overheat in the preset refrigeration expansion valve opening degree table. The preset refrigeration expansion valve opening degree table includes a corresponding relationship between the overheat degree and the opening degree, and the corresponding relationship between the overheat degree and the opening degree can be obtained through experiments, which is not limited in this embodiment.

In the second embodiment, by obtaining the overheat degree of the refrigeration electronic expansion valve, the opening degree of the refrigeration electronic expansion valve is adjusted according to the overheat degree of the refrigeration electronic expansion valve, so as to throttle the air conditioner, thereby improving the control accuracy of the refrigeration electronic expansion valve.

Figure 6:
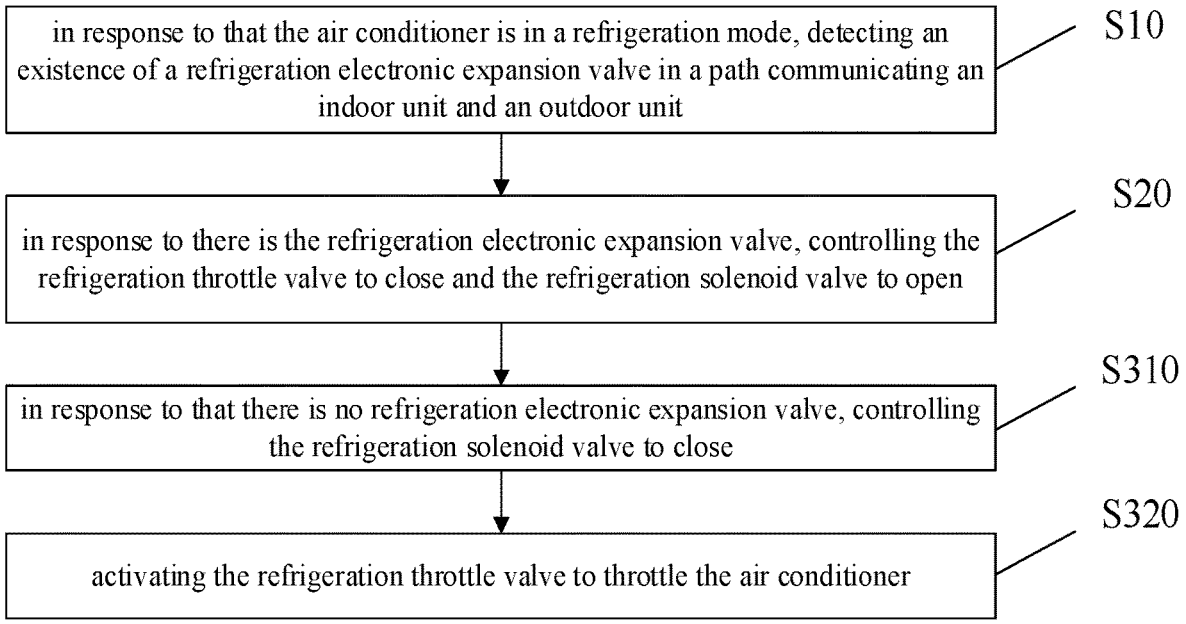
FIG. 6 is a schematic flowchart of an air conditioner control method according to a third embodiment of the present application.

Referring to FIG. 6, FIG. 6 is a schematic flowchart of an air conditioner control method according to a third embodiment of the present application. Based on the first embodiment shown in FIG. 2, the third embodiment of the air conditioner control method of the present application is provided.

In the third embodiment, after the S20, the method also includes:

S310: in response to that there is no refrigeration electronic expansion valve, controlling the refrigeration solenoid valve to close.

It should be understood that in response to that there is no refrigeration electronic expansion valve, the refrigerant needs to be throttled through the refrigeration throttle valve. In order to enable the refrigeration throttle valve to throttle the refrigerant, it is necessary to close the refrigeration solenoid valve, so that the bypass branch where the refrigeration solenoid valve is located is closed, no refrigerant flows, and the refrigerant flows through the branch where the refrigeration throttle valve is located.

S320: activating the refrigeration throttle valve to throttle the air conditioner.

It can be understood that, in order to throttle the refrigerant, it is necessary to activate the refrigeration throttle valve to throttle the refrigerant flowing into the branch where the refrigeration throttle valve is located to form the refrigerant with low temperature and low pressure.

Further, in order to improve the control accuracy of refrigeration throttle valve, S310 includes:

obtaining the overheat degree of the refrigeration throttle valve;

The opening degree of the refrigeration throttle valve is adjusted according to the overheat degree of the refrigeration throttle valve to throttle the air conditioner.

It should be noted that the overheat degree is used for expansion valves and refers to the temperature difference between the low pressure side and the steam in the temperature sensing bulb.

It should be understood that adjusting the opening degree of the refrigeration throttle valve according to the overheat degree of the refrigeration throttle valve to throttle the air conditioner may be searching for the opening degree of the refrigeration throttle corresponding to the overheat degree in the preset refrigeration throttle valve opening degree table. The refrigeration throttle valve opening degree table includes the corresponding relationship between the overheat degree and the opening degree, and the corresponding relationship between the overheat degree and the opening degree can be obtained through experiments, which is not limited in this embodiment.

Figure 7:
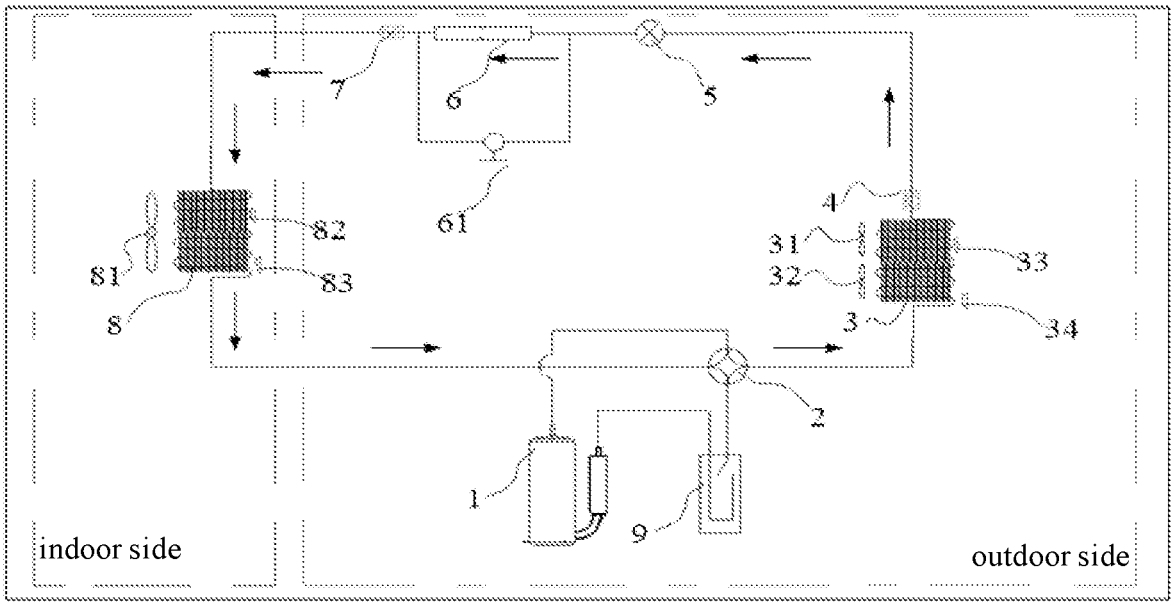
FIG. 7 is a schematic diagram showing the refrigerant flow in response to that the air conditioner is in the refrigeration mode and there is no refrigeration electronic expansion valve of the air conditioner control method according to an embodiment of the present application.

For ease of understanding, referring to FIG. 7 for illustration, FIG. 7 is a schematic diagram showing the refrigerant flow in response to the air conditioner is in the refrigeration mode and there is no refrigeration electronic expansion valve of the air conditioner control method according to an embodiment of the present application. In response to that the air conditioner is in the refrigeration mode, the gas refrigerant with high temperature and high pressure discharged from the compressor 1 passes through the four-way valve 2, enters the condenser 3 side for heat dissipation, passes through the filter 4 and the heating electronic expansion valve 5 (at this time, the opening degree of the electronic expansion valve 5 reaches the maximum 480 steps and has no throttling function), and enters the refrigeration throttle valve 6. After throttled by the refrigeration throttle valve 6, the refrigerant with low temperature and low pressure is formed, then the refrigerant enters the indoor side evaporator 8 for endothermic evaporation, and flows into the gas-liquid separator 9 for gas-liquid separation. The gas refrigerant returns to the compressor 1 for circulation, and the liquid refrigerant is stored in the gas-liquid separator 9. The refrigeration solenoid valve 61 is in a normally closed state, that is, the bypass branch where it is located is in a closed state, no refrigerant flows, and the refrigerant flows through the branch where the refrigeration throttle valve 6 is located.

In the third embodiment, in response to that there is no refrigeration electronic expansion valve, the refrigeration solenoid valve is controlled to close, and the refrigeration throttle valve is activated to throttle the air conditioner. When the product of the outside refrigeration throttle assembly is matched with the product without the refrigeration throttling, the refrigerant can be effectively throttled through the communication of the refrigeration throttle valve branch and the closure of the refrigeration solenoid valve branch.

Figure 8:
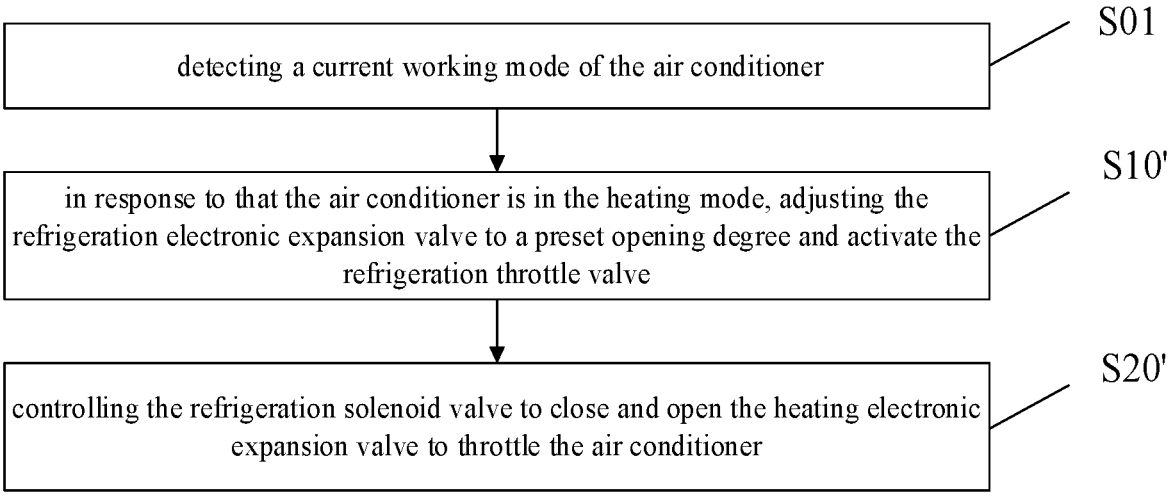
FIG. 8 is a schematic flowchart of an air conditioner control method according to a fourth embodiment of the present application.

Referring to FIG. 8, FIG. 8 is a schematic flowchart of the air conditioner control method according to a fourth embodiment of the present application. Based on the first embodiment shown in FIG. 2, the fourth embodiment of the air conditioner control method of the present application is provided.

In the fourth embodiment, the air conditioner further includes a heating electronic expansion valve.

Before S10, the method also includes:

S01: detecting a current working mode of the air conditioner.

It should be noted that the current working mode may be the refrigeration mode, the heating mode, etc., which is not limited in this embodiment.

It should be understood that the current working mode of the air conditioner can be determined by receiving a working mode identifier uploaded by the air conditioner. The working mode identifier may be the identification information used to represent the working mode.

S10': in response to that the air conditioner is in the heating mode, adjusting the refrigeration electronic expansion valve to a preset opening degree and activating the refrigeration throttle valve.

It should be noted that the preset opening degree may be a maximum opening degree of the refrigeration electronic expansion valve. In this embodiment and other embodiments, 480 step is taken as an example for illustration.

It should be understood that when adjusted to the maximum opening degree, the refrigeration electronic expansion valve does not have the throttling function.

It can be understood that in response to the air conditioner is in the heating mode, the refrigeration throttle valve does not have the throttling function, i.e., refrigeration with throttling at one-way, and heating at reverse without throttling, that is, allowing the refrigerant to flow through.

S20': controlling the refrigeration solenoid valve to close and open the heating electronic expansion valve to throttle the air conditioner.

It should be understood that in response to that the air conditioner is in the heating mode, the refrigeration solenoid valve is not normally closed, that is, the bypass branch where it is located is closed, and no refrigerant flows.

It can be understood that the heating electronic expansion valve is opened to throttle the refrigerant to form the refrigerant with low temperature and low pressure.

Figure 9:
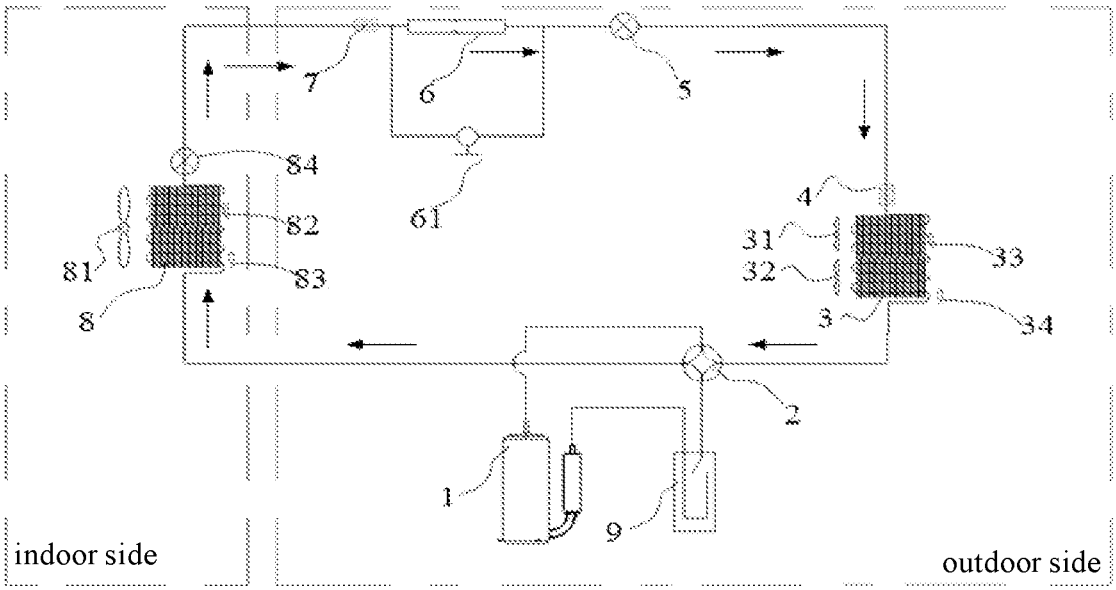
FIG. 9 is a schematic diagram showing the refrigerant flow in response to that the air conditioner is in a heating mode of the air conditioner control method according to an embodiment of the present application.

For ease of understanding, an example is given with reference to FIG. 9, which is a schematic diagram showing the refrigerant flow in response to the air conditioner is in the heating mode of the air conditioner control method according to an embodiment of the present application. In response to that the air conditioner is in the heating mode, the gas refrigerant with high temperature and high pressure discharged from the compressor 1 flows through the four-way valve 2, enters the evaporator 8 side for heat dissipation, flows through the refrigeration electronic expansion valve 84 (in response to the air conditioner is in the heating mode, the electronic expansion valve reaches the maximum 480 steps and has no throttling function), the filter 7, the refrigeration throttle valve 6 (in response to the air conditioner is in the heating mode, it has no throttling function, that is, refrigeration with throttling at one-way, and heating at reverse without throttling), and the heating electronic expansion valve 5 (in response to that the air conditioner is in the heating mode, the refrigerant is throttled and depressurized by the heating electronic expansion valve 5). After throttled in the heating electronic expansion valve 5, the refrigerant with low temperature and low pressure is formed. The refrigerant then enters the outdoor side condenser 3 to absorb heat and evaporate, and flows into the gas-liquid separator 9 to get the gas-liquid separation. The gas refrigerant returns to the compressor 1 for circulation, and the liquid refrigerant is stored in the gas-liquid separator 9. The refrigeration solenoid valve 61 is in the normally closed state, that is, the bypass branch where it is located is in the closed state, no refrigerant flows, and the refrigerant flows through the branch where the refrigeration throttle valve 6 is located.

In a fourth embodiment, the heating electronic expansion valve is provided and a current working mode of the air conditioner is detected. In response to that the air conditioner is in the heating mode, the refrigeration electronic expansion valve is adjusted to the preset opening degree; the refrigeration throttle valve is controlled to open, and the refrigeration solenoid valve is controlled to close, so as to throttle the air conditioner, thereby throttling the refrigerant to form the refrigerant with low temperature and low pressure in response to that the air conditioner is in the heating mode.

In addition, the present application also provide a storage medium on which an air conditioner control program is stored. When the air conditioner control program is executed by a processor, the steps of the air conditioner control method described above are implemented.

Figure 10:
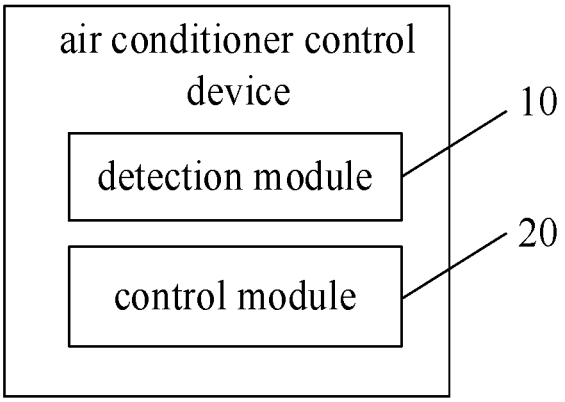
FIG. 10 is a structural block diagram of an air conditioner control device according to the first embodiment of the present application.

In addition, referring to FIG. 10, the present application also provides an air conditioner control device, including: a detecting module 10 and a control module 20.

In this embodiment, the air conditioner control device is applied to the air conditioner. The air conditioner includes the indoor unit and the outdoor unit. The refrigeration throttle valve and the refrigeration solenoid valve are provided in parallel in the path communicating the outdoor unit and the indoor unit.

For ease of understanding, an example is provided with reference to FIG. 3. FIG. 3 is the schematic system diagram of the air conditioner of the air conditioner control method according to an embodiment of the present application. The air conditioner includes the compressor 1, the four-way valve 2, the condenser 3, the upper blower 31, the lower blower 32, and the pipeline temperature sensor 33, the outdoor environment temperature sensor 34, the filter 4, the heating electronic expansion valve 5, the refrigeration throttle valve 6, the refrigeration solenoid valve 61, the filter 7, the evaporator 8, the inner blower 81, the indoor pipeline temperature sensor 82, the indoor environment temperature sensor 83, the refrigeration electronic expansion valve 84 and the gas-liquid separator 9. The compressor 1 is used for compressing and transporting the refrigerant. The four-way valve 2 is used to switch between refrigeration and heating. in response to the air conditioner is in the refrigeration mode, the condenser 3 is used as the condensing end to dissipate the heat for the refrigerant; in response to the air conditioner is in the heating mode, the condenser 3 is used as the evaporation end to absorb the heat for the refrigerant. The upper blower 31 and the lower blower 32 are used to drive the outdoor air to pass through the heat ex-changer, so that the air exchanges heat with the refrigerant in the pipe. The pipeline temperature sensor 33 is used to detect the temperature of the surface of the copper pipeline. The outdoor environment temperature sensor 34 is used to detect the temperature of the outdoor air. The filter 4 and the filter 7 are used to prevent impurities in the system from entering the throttle assemblies, resulting in the poor throttling function or the dirt and blockage. In response to that the air conditioner is in the heating mode, the heating electronic expansion valve 5 is used for throttling and reducing the pressure; in response to that the air conditioner is in the refrigeration mode, the heating electronic expansion valve 5 is set to a maximum of 480 steps without the throttling function, that is, throttling at one-way, and full opening at reverse without throttling. In response to that the air conditioner is in the refrigeration mode, the refrigeration solenoid valve 61 is closed, and the refrigeration electronic expansion valve 84 is opened to a maximum of 480 steps, the refrigeration throttle valve 6 is used to play the role of throttling and reducing the pressure. If the refrigeration solenoid valve 61 is opened, the refrigeration throttle valve 6 has no throttling function, and the refrigeration electronic valve expansion valve 84 has the function of throttling and reducing the pressure, which is controlled by the overheat degree. The refrigeration throttle valve 6 does not function in response to the air conditioner is in the heating mode. In response to that the air conditioner is in the heating mode, the refrigeration throttle valve 6 no longer throttles, that is, throttling at one-way, and no throttling at reverse. The refrigeration solenoid valve 61 is in a normally closed state. After energized, the refrigeration solenoid valve 61 functions to bypass the refrigeration solenoid valve, and reduce the pressure drop of the refrigerant and make the refrigerant before throttling by the refrigeration electronic expansion valve 84 to be in the liquid state, thus preventing the gas-liquid mixture which produces the refrigerant sound. In response to that the air conditioner is in the refrigeration mode, the evaporator 8 is used as the evaporation end to absorb the heat for the refrigerant; in response to that the air conditioner is in the heating mode, the evaporator 8 is used as the condensation end to dissipate the heat for the refrigerant. The inner blower 81 is used to drive the indoor air to pass through the heat ex-changer, so that the air exchanges heat with the refrigerant in the pipe. The indoor pipeline temperature sensor 82 is used to detect the temperature of the surface of the copper pipeline of the indoor heat exchanger. The indoor environment temperature sensor 83 is used to detect the temperature of the indoor environment. In response to that the air conditioner is in the refrigeration mode, the refrigeration electronic expansion valve 84 is used to control the electronic expansion valve according to the overheat degree; in response to that the air conditioner is in the heating mode, the refrigeration electronic expansion valve 84 reaches the maximum of 480 steps and has no throttling function. The gas-liquid separator 9 is used to separate the gas and liquid refrigerants in the system. The gas refrigerant returns to the compressor to continue the compression cycle, while the liquid refrigerant remains in the gas-liquid separator to avoid the compressor liquid shock. The outdoor unit in the present application may include the condenser 3, the upper blower 31, the lower blower 32, the pipeline temperature sensor 33, and the outdoor environment temperature sensor 34. The indoor unit may include the evaporator 8, the inner blower 81, the indoor pipeline temperature sensor 82 and the indoor environment temperature sensor 83, which is not limited in this embodiment.

In this embodiment, the detection module 10 is configured to detect whether there is the refrigeration electronic expansion valve in the path communicating the indoor unit and the outdoor unit in response to that the air conditioner is in the refrigeration mode.

It should be understood that in response to that the refrigeration electronic expansion valve is in the refrigeration mode, the electronic expansion valve is controlled according to the overheat degree; in response to that the air conditioner is in the heating mode, the electronic expansion valve is opened to the maximum opening degree and does not throttle. The maximum opening degree being 480 steps is taken as an example for description.

When products produced by different manufacturers are matched together, it may happen that the product with the refrigeration throttle assembly on the outside is matched with the product with the refrigeration throttle assembly on the inside, resulting in double throttle valves, which will cause the noise on the indoor side and affect the comfort. Therefore, it is necessary to detect whether there is the refrigeration electronic expansion valve in the path communicating the indoor unit and the outdoor unit.

The control module 20 is used to control the refrigeration throttle valve to close and the refrigeration solenoid valve to open in response to there is the refrigeration electronic expansion valve.

It should be understood that in response to the refrigeration throttle valve is closed, there is no refrigerant circulation in the refrigeration throttle valve. In response to the refrigeration solenoid valve is opened, the refrigeration solenoid valve is activated, so that the bypass branch where the refrigeration solenoid valve is located is in the open state to circulate refrigerant and reduce the pressure of the refrigerant, so that the refrigerant is in the liquid state when entering the refrigeration electronic expansion valve.

The control module 30 is also used to activate the refrigeration electronic expansion valve to throttle the air conditioner.

It should be understood that after the refrigeration throttle valve is closed, only the refrigeration electronic expansion valve can throttle the refrigerant, thereby forming the refrigerant with low temperature and low pressure.

For ease of understanding, refer to FIG. 4. FIG. 4 is the schematic diagram showing the refrigerant flow in response to that the air conditioner is in the refrigeration mode and there is the refrigeration electronic expansion valve of the air conditioner control method according to an embodiment of the present application. In response to that the air conditioner is in the refrigeration mode, the gas refrigerant with high temperature and high pressure discharged from the compressor 1 passes through the four-way valve 2, enters the condenser 3 side for heat dissipation, passes through the filter 4 and the heating electronic expansion valve 5 (at this time, the opening degree of the electronic expansion valve 5 reaches the maximum 480 steps and has no throttling function), and enters and bypasses the refrigeration solenoid valve 61, which reduces the pressure drop of the refrigerant, and causes the refrigerant to be in the liquid state when entering the refrigeration electronic expansion valve 84 to avoid the refrigerant sound produced by the gas-liquid in two-phase. After throttled by the refrigeration electronic expansion valve 84, the refrigerant with low temperature and low pressure is formed, then the refrigerant enters the indoor side evaporator 8 for endothermic evaporation, and flows into the gas-liquid separator 9 for gas-liquid separation. The gas refrigerant returns to the compressor 1 for circulation, and the liquid refrigerant is stored in the gas-liquid separator 9.

In the present application, the refrigeration throttle valve and the refrigeration solenoid valve are provided in parallel in the path communicating the outdoor unit and the indoor unit. In response to that the air conditioner is in the refrigeration mode, it is detected whether there is the refrigeration electronic expansion valve in the path communicating the indoor unit and the outdoor unit. Based on the detection of the existence of the refrigeration electronic expansion valve, controlling the refrigeration throttle valve to close, controlling the refrigeration solenoid valve to open, and activating the refrigeration electronic expansion valve to throttle the air conditioner. Thus, in response to detecting that there is the refrigeration electronic expansion valve on the indoor side, bypassing the refrigeration solenoid valve, so as to overcome the noise in the room resulting from the double throttle valves when the product with the refrigeration throttle assembly inside is connected, thereby improving product competitiveness.

Other embodiments or implementations of the air conditioner control device described in the present application may refer to the above method embodiments, and will not be described again here.

It should be noted that in the present application, the terms "comprising," "including," or any other variation thereof are intended to cover non-exclusive inclusion, so that a process, a method, an article or a system that includes a series of elements not only includes those elements, but also includes other elements not expressly listed or inherent in such process, method, article or system. Without further limitation, an element defined by the statement "comprises a . . . " does not exclude the presence of other identical elements in the process, the method, the article, or the system that includes that element.

The above serial numbers of the embodiments of the present application are only for description and do not represent the advantages or disadvantages of the embodiments. In the element claim enumerating several means, several of these means may be embodied by the same item of the hardware. The use of the first, second, third, etc. does not indicate any order and may be interpreted as names.

Through the above description of the embodiments, those skilled in the art can clearly understand that the methods of the above embodiments can be implemented by means of software plus a necessary general hardware platform. It can also be implemented by the hardware, but in many cases the former is a better implementation. Based on this understanding, the technical solution of the present application can be embodied in the form of a software product in essence or that contributes to the existing technology. The computer software product is stored in a storage medium (such as a read-only memory image (ROM) or a random access memory (RAM), a magnetic disk, and an optical disk), including a number of instructions to make a terminal device (such as a mobile phone, a computer, a server, an air conditioner, or a network equipment etc.) to perform the methods described in embodiments of the present application.

The above are only some embodiments of the present application, and do not limit the scope of the present application. Any equivalent structure or equivalent process transformation made by using the specification and drawings of the application, or directly or indirectly used in other related technical fields, are all included in the scope of the present application in the same way.

What is claimed is:

1. An air conditioner control method comprising:

in response to that an air conditioner is in a refrigeration mode, detecting whether a refrigeration electronic expansion valve exists in a path communicating an indoor unit and an outdoor unit of the air conditioner;

in response to determining that the refrigeration electronic expansion valve exists in the path, controlling a refrigeration throttle valve to close and a refrigeration solenoid valve to open, the refrigeration throttle valve and the refrigeration solenoid valve being provided in parallel in the path, a first filter being connected between the refrigeration electronic expansion valve and each of a first end of the refrigeration throttle valve and a first end of the refrigeration solenoid valve, and a second filter being connected between a condenser and each of a second end of the refrigeration throttle valve and a second end of the refrigeration solenoid valve via a heating electronic expansion valve; and activating the refrigeration electronic expansion valve to throttle the air conditioner.

2. The air conditioner control method of claim 1, wherein activating the refrigeration electronic expansion valve to throttle the air conditioner includes:

obtaining an overheat degree of the refrigeration electronic expansion valve; and adjusting an opening degree of the refrigeration electronic expansion valve according to the overheat degree.

3. The air conditioner control method of claim 1, wherein controlling the refrigeration throttle valve to close and the refrigeration solenoid valve to open includes:

obtaining an outlet temperature of a condenser of the outdoor unit; and adjusting an opening degree of the refrigeration solenoid valve according to the outlet temperature of the condenser, and controlling the refrigeration throttle valve to close.

4. The air conditioner control method of claim 1, further comprising, after detecting whether the refrigeration electronic expansion valve exists in the path:

in response to that no refrigeration electronic expansion valve exists, controlling the refrigeration solenoid valve to close, and activating the refrigeration throttle valve to throttle the air conditioner.

5. The air conditioner control method of claim 4, wherein activating the refrigeration throttle valve to throttle the air conditioner includes:

obtaining an overheat degree of the refrigeration throttle valve; and adjusting an opening degree of the refrigeration throttle valve according to the overheat degree of the refrigeration throttle valve to throttle the air conditioner.

6. The air conditioner control method of claim 1, wherein detecting whether the refrigeration electronic expansion valve exists in the path includes:

obtaining information of the indoor unit; and extracting an equipment identification of the indoor unit from the information of the indoor unit, and detecting whether the refrigeration electronic expansion valve exists in the indoor unit according to the equipment identification of the indoor unit.

7. The air conditioner control method of claim 1, further comprising, before detecting whether the refrigeration electronic expansion valve exists in the path:

detecting a current working mode of the air conditioner; and in response to that the air conditioner is in a heating mode:

adjusting the refrigeration electronic expansion valve to a preset opening degree, and activating the refrigeration throttle valve; and controlling the refrigeration solenoid valve to close, and opening a heating electronic expansion valve of the air conditioner to throttle the air conditioner.

8. A non-transitory computer-readable storage medium storing an air conditioner control program that, when executed by a processor, causes the processor to perform the air conditioner control method of claim 1.

9. An air conditioner comprising:

an indoor unit and an outdoor unit, a refrigeration throttle valve and a refrigeration solenoid valve being provided in parallel in a path communicating the outdoor unit and the indoor unit;

a processor; and a memory storing an air conditioner control program that, when executed by the processor, causes the processor to:

in response to that the air conditioner is in a refrigeration mode, detecting whether a refrigeration electronic expansion valve exists in the path;

in response to determining that the refrigeration electronic expansion valve exists in the path, controlling the refrigeration throttle valve to close and the refrigeration solenoid valve to open, a first filter being connected between the refrigeration electronic expansion valve and each of a first end of the refrigeration throttle valve and a first end of the refrigeration solenoid valve, and a second filter being connected between a condenser and each of a second end of the refrigeration throttle valve and a second end of the refrigeration solenoid valve via a heating electronic expansion valve; and activating the refrigeration electronic expansion valve to throttle the air conditioner.

10. The air conditioner of claim 9, wherein the program further causes the processor to:

obtain an overheat degree of the refrigeration electronic expansion valve; and adjust an opening degree of the refrigeration electronic expansion valve according to the overheat degree.

11. The air conditioner of claim 9, wherein the program further causes the processor to:

obtain an outlet temperature of a condenser of the outdoor unit; and adjust an opening degree of the refrigeration solenoid valve according to the outlet temperature of the condenser, and controlling the refrigeration throttle valve to close.

12. The air conditioner of claim 9, wherein the program further causes the processor to, after detecting whether the refrigeration electronic expansion valve exists in the path:

in response to that no refrigeration electronic expansion valve exists, control the refrigeration solenoid valve to close, and activate the refrigeration throttle valve to throttle the air conditioner.

13. The air conditioner of claim 12, wherein the program further causes the processor to:

obtain an overheat degree of the refrigeration throttle valve; and adjust an opening degree of the refrigeration throttle valve according to the overheat degree of the refrigeration throttle valve to throttle the air conditioner.

14. The air conditioner of claim 9, wherein the program further causes the processor to:

obtain information of the indoor unit; and extract an equipment identification of the indoor unit from the information of the indoor unit, and detect whether the refrigeration electronic expansion valve exists in the indoor unit according to the equipment identification of the indoor unit.

15. The air conditioner of claim 9, wherein the program further causes the processor to, before detecting whether the refrigeration electronic expansion valve exists in the path:

detect a current working mode of the air conditioner; and in response to that the air conditioner is in a heating mode:

adjust the refrigeration electronic expansion valve to a preset opening degree, and activating the refrigeration throttle valve; and control the refrigeration solenoid valve to close, and opening a heating electronic expansion valve of the air conditioner to throttle the air conditioner.

16. An air conditioner control device comprising:

a processor; and a memory storing an air conditioner control program that, when executed by the processor, causes the processor to perform the air conditioner control method of claim 11.

17. The device of claim 16, wherein the program further causes the processor to:

obtain an overheat degree of the refrigeration electronic expansion valve; and adjust an opening degree of the refrigeration electronic expansion valve according to the overheat degree.

18. The device of claim 16, wherein the program further causes the processor to:

obtain an outlet temperature of a condenser of the outdoor unit; and adjust an opening degree of the refrigeration solenoid valve according to the outlet temperature of the condenser, and controlling the refrigeration throttle valve to close.

19. The device of claim 16, wherein the program further causes the processor to, after detecting whether the refrigeration electronic expansion valve exists in the path:

in response to that no refrigeration electronic expansion valve exists, control the refrigeration solenoid valve to close, and activate the refrigeration throttle valve to throttle the air conditioner.

20. An air conditioner control method comprising:

in response to that an air conditioner is in a refrigeration mode, detecting whether a refrigeration electronic expansion valve exists in a path communicating an indoor unit and an outdoor unit of the air conditioner, including:

obtaining information of the indoor unit, the information including manufacturer information or model information of the indoor unit;

extracting an equipment identification of the indoor unit from the information of the indoor unit, the equipment identification of the indoor unit representing an identity of the indoor unit;

searching equipment information corresponding to the equipment identification of the indoor unit in a preset information table, the equipment information including information of equipment that the indoor unit is composed of, and detecting whether the refrigeration electronic expansion valve exists in the indoor unit according to the equipment information of the indoor unit;

in response to determining that the refrigeration electronic expansion valve exists in the path, controlling a refrigeration throttle valve to close and a refrigeration solenoid valve to open, the refrigeration throttle valve and the refrigeration solenoid valve being provided in parallel in the path; and activating the refrigeration electronic expansion valve to throttle the air conditioner.

* * * * *